United States Patent [19]

Spencer, III et al.

[11] 4,261,347

[45] Apr. 14, 1981

[54] HYDROMASSAGE FITTING FOR TUBS, SPAS AND POOLS

[75] Inventors: Terrel Spencer, III, Little Rock; Joe D. Puckett, Benton, both of Ark.

[73] Assignee: Jacuzzi Bros., Inc., Little Rock, Ark.

[21] Appl. No.: 100,921

[22] Filed: Dec. 6, 1979

[51] Int. Cl.[3] ..... A61H 9/00; B05B 15/08

[52] U.S. Cl. ..... 128/66; 239/428.5; 239/587

[58] Field of Search ..... 128/66; 4/178, 180, 4/492, 542, 543, 559; 239/587, 428.5

[56] References Cited

U.S. PATENT DOCUMENTS

| | | | |
|---|---|---|---|
| 3,540,438 | 11/1970 | Jacuzzi | 128/66 |
| 3,905,358 | 9/1975 | Jacuzzi | 128/66 |
| 4,082,091 | 4/1978 | Raab | 128/66 |

*Primary Examiner*—Robert W. Michell
*Assistant Examiner*—Arthur S. Rose
*Attorney, Agent, or Firm*—Hill, Van Santen, Steadman, Chiara & Simpson

[57] ABSTRACT

A hydrotherapeutic aerator assembly for mixing air as fine bubbles into a stream of pressurized water has a swivelable ball mating with a housing and utilizes a one-piece annular seal and retaining member with an elastically pliant lip formed on the interior diameter thereof which is attachable to the housing and engages the ball to seal and retain the ball in selectively adjusted positions.

8 Claims, 3 Drawing Figures

HYDROMASSAGE FITTING FOR TUBS, SPAS AND POOLS

BACKGROUND OF THE INVENTION

1. Field of the Invention

The present invention relates to an improvement in a fitting used to combine air with a pressurized water stream in swimming pools, spas, and baths for aeration, hydrotherapy, hydromassage, and similar purposes.

2. Description of Prior Art

The state of the art is represented by three patents owned or controlled by applicant's assignee. In Jacuzzi U.S. Pat. No. 3,905,358, a hydro-air fitting is utilized in which a ball is mounted in two sealing members and a retaining member each separately fitted with the housing. A nozzle is either removable from within the ball or is retained therein by a separate set screw passed through the ball.

The Roy Jacuzzi U.S. Pat No. 3,540,438 discloses a hydro-air jet assembly wherein a rear portion of the housing is formed as a socket against which a swivelable ball is retained by a two-piece seal and retaining member separately attached to the housing. A pair of set screws spaced axially apart in a side wall of the ball forms stop members against respective front and rear ridges forming a seat for a sealing member between water and air passages of the assembly.

The Alfred Raab U.S. Pat. No. 4,082,091, assigned to the assignee of the present invention, discloses a hydro-air fitting in which a ball is mounted into a spherical configuration formed directly in the hollow housing member, and a one-piece sealing and retaining member holds the ball in the housing. Further, a flexible ring or split ring is fitted in a channel about a rearward portion of the nozzle to abut against a circumferential surface formed on the ball to provide positive protection of withdrawal of the nozzle from the ball.

SUMMARY OF THE INVENTION

The configuration and the material used in the one-piece sealing and retaining member are changed to prevent galling between the ball and the seal, to provide a more efficient seal, and to reduce reliance on strict compliance with manufacturing tolerances, resulting in more economical production.

After exposure to the sun and chlorinated water some of the relatively movable parts used in pools tend to gall, that is there may be damaging frictional rubbing between two parts, for example, between the ball and the adjoining sealing and retaining member which would cause the parts to "chalk", i.e. develop an oxide-like coating. "Chalking" interferes with the proper operation of the swiveling movement of the ball within the hydro-therapy or swimming pool return fitting and can be accommodated by readjustment of the assembly screws.

In any fitting handling water and air under pressure the sealing and retention means are usually made with close manufacturing tolerances demanding accurate molding of the body, ball, and sealing and retaining member and proper application of a specific torque to the assembly screws.

The present invention provides for improving the one-piece annular sealing and retention member by forming a lip on the interior diameter of such member and making the member pliable instead of rigid. The combination of such a lip with the new flexibility of the member obviates the necessity of maintaining adherence to close manufacturing tolerances, without loss of function.

The components provided in accordance with the present invention are assembled into a return fitting in the same manner as before, except that the assembly operation and swivel characteristics of the assembly are no longer sensitive to close manufacturing tolerances. Additionally the parts are less susceptible to galling and the unit is forgiving of "chalk" build up on the ball. The structure of the invention will operate smoothly, even after exposure to the sun and chlorinated water, without the need for readjusting the assembly screws.

DESCRIPTION OF THE PREFERRED EMBODIMENTS

Figure 1:
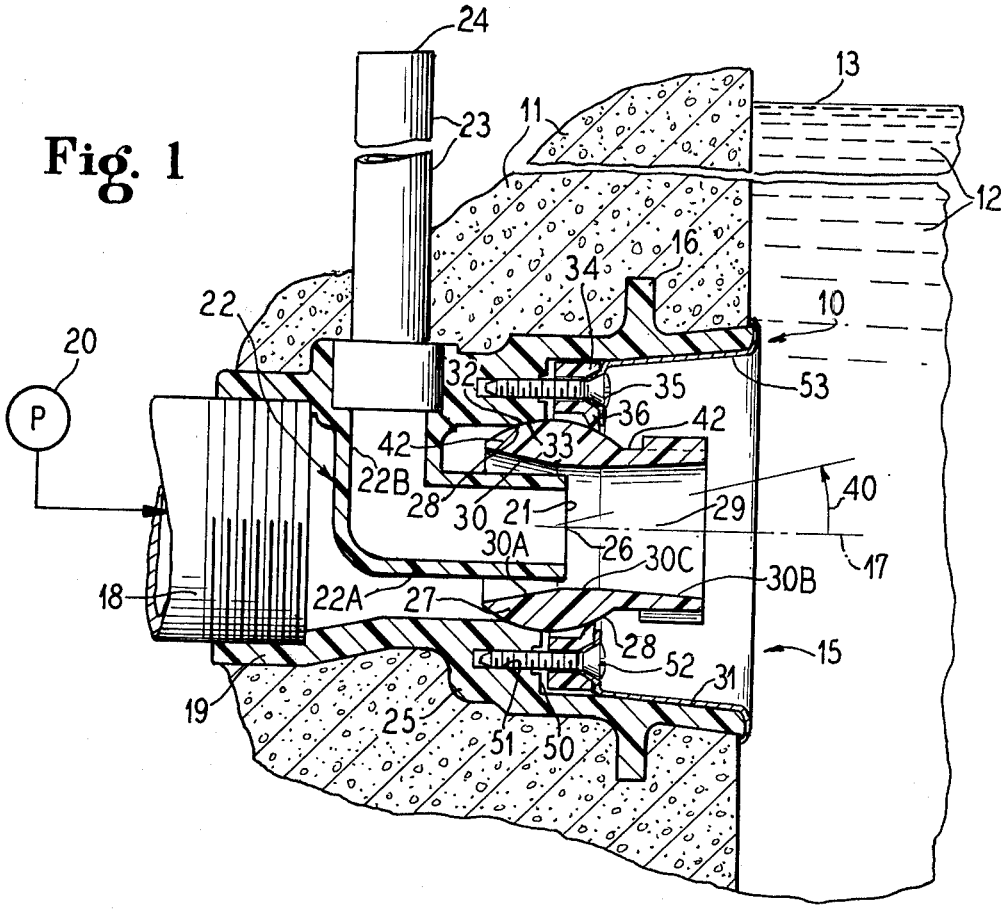
FIG. 1 is a longitudinal, side sectional view through the improved hydromassage fitting of the present invention.
Figure 2:
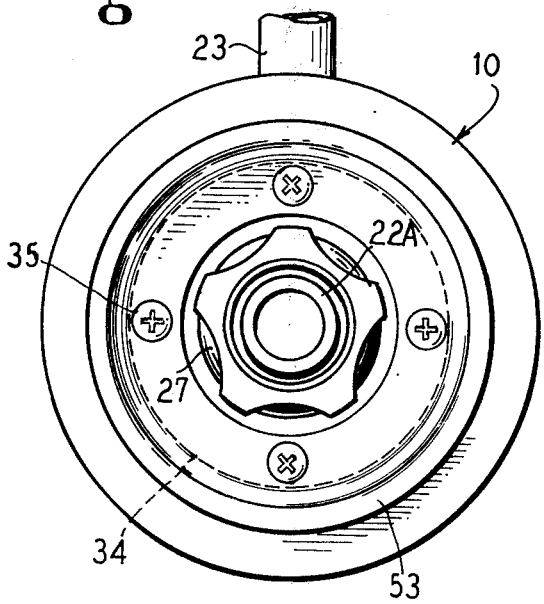
FIG. 2 is a front view of the device shown in FIG. 1.

An improved hydromassage fitting 10 is shown in FIG. 1 mounted in a wall 11 of a pool of water 12 having a maximum level indicated at 13. While the wall 11 is shown as a concrete structure and a housing 15 of the fitting 10 is specifically adapted for mounting therein as by a radially extending flange 16, suitable modification of the housing 15 can adapt the fitting 10 for use in thin-walled pool, spa or tub enclosures, as is believed to be known to those skilled in the art.

The housing 15 is a hollow, molded article made in one piece of a plastic or thermoplastic material and generally having a central axis indicated at 17. An interior of the housing 15 is charged with water through a conduit 18 provided on the axis 17 at a rearward portion 19 of the housing, the water conduit 18 being supplied with pressurized water from a source such as a pump 20. A supply of air is also provided to the interior of the housing 15 along the axis 17 at an air port 21 formed at an end of an axially extending tubular member 22A forming a horizontal leg of an e11 member 22 having a vertical leg being a radially extending tubular member 22B which communicates with an air conduit 23 extending to an air intake opening 24 arranged gravitationally above the maximum fluid level 13 of the water body 12.

In a central portion 25 of the housing 15, centered about an intersection 26 between the axis 17 and the fixed air port 21 is a ball 27 having a spherical outer surface 28. The ball 27 has an interior flow passage 29 comprising a nozzle 30 defining, respectively, in a downstream direction toward a forward end 31 of the housing 15, relatively converging section 30A and diverging section 30B on opposite sides of a throat 30C.

The ball 27 is received in the housing 15 by a spherical socket portion 32 which engages against a rearward spherical surface 33 of the ball 27. The rearward ball socket surface 32 is molded or otherwise formed directly in the center portion 25 of the housing 15.

The ball 27 is retained in the housing 15 by an annular, one-piece sealing and retaining member 34 fitted into the housing 15 about the ball 27 and secured in place by an escutcheon ring 53 and attachment means such as a plurality of screws 35 which are secured to the housing 15. The rigid escutcheon ring 53 which may be made of metal or any suitably rigid material i.e., relatively hard as contrasted with the softer material of the member 34, provides a uniform load against the ball 27 around the entire circumference of the sealing and retaining member 34 ensuring a completely water-tight seal. Additionally, the escutcheon ring 53 may be formed of metal and either chrome or gold plated to enhance the esthetic appearance of the hydromassage fitting 10 after its installation in a pool, spa or tub.

Figure 3:
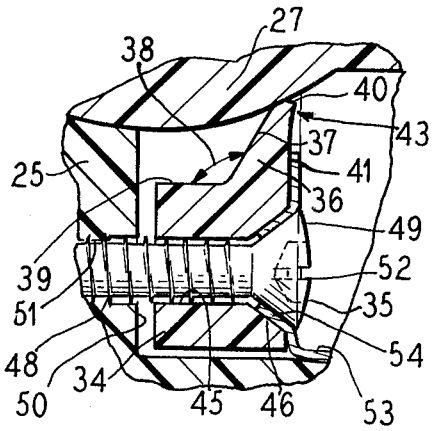
FIG. 3 is an enlarged side sectional view of the detail of FIG. 1.

In accordance with the principles of the present invention, and as best seen in FIG. 3, the sealing and retaining member 34 is provided with an annular lip 36 formed on an interior diameter 39 of the member 34. The lip 36 extends radially inwardly to a diameter which is less than the outer diameter of the ball 27, thereby facilitating the development of a clamping purchase for confining the ball 27 in a socket.

The lip 36 is comprised of a first inner wall portion 37 formed at an obtuse angle 38, for example 115 degrees, to the interior diameter wall 39, the latter wall 39 being parallel to the axis 17 of the member 34. The angled wall portion 27 is of a height approximately ⅓ of the entire radial extent of the member 34 and defines a smaller interior diameter and terminates at its outer radial extent in a second narrow wall portion 40 parallel to the axis of the member 34 so that the member 34 is radially sized to fit between the ball 27 and the conical wall of the housing 15.

A third outer wall portion 41 is generally perpendicular to the interior diameter wall 39 and connects the second narrow wall portion 40 to the interior diameter wall 39 and is flush with an end of such wall 39. The member 34 permits easily swiveling of the ball 27 about the point 26 through an angle 40 in any direction about the axis 17, until a collar 42 abuts against member 34.

The escutcheon ring 53 has a plurality of equiangularly spaced axially extending apertures 54 formed therein each having a beveled depression to pass and cooperatively seat bevel-headed screws 35 having screw threaded shanks 48 and bevel heads 49.

The sealing and retaining member 34 has a plurality of equiangularly spaced axially extending apertures 45 formed therein each counterbored as at 46 to axially line up with the escutcheon apertures 54 and to pass and seat the bevel-headed screws 35. The housing 15 has a generally radial wall 50 in which a plurality of corresponding threaded openings 51 are formed for matingly receiving the corresponding screws 35. Each of the bevel heads 49 are slotted as at 52 for cooperation with a tool such as a screw driver so that the ring member 34 may be placed in firm assembly with the housing 15.

The member 34 is preferably formed of a relatively high durometer, low friction elastomer such as Hytrel which has a durometer of A 90. This material is resilient and compressible so that the lip 36 is essentially characterized as relatively flexible and elastic. By virtue of such characteristics the need for close manufacturing tolerances is eliminated and a pliant contact is afforded between the lip 36 and the exterior surface of the ball 27 which helps to eliminate problems of galling between the ball 27 and the member 34 by being more tolerant of the "chalk" build up on the ball 27. The use of such dissimilar materials in the ball 27 and in the member 34 also helps to reduce the problem of galling. Additionally since the member 34 is pliant, when the escutcheon ring 53 and attachment means 35 secure the member 34 against the ball 27, there is a slight distortion 43 of the lip 36 resulting in a positive water-tight seal between the ball 27 and the member 34.

Although various minor modifications may be suggested by those versed in the art, it should be understood that I wish to embody within the scope of the patent warranted hereon all such modifications as reasonably and properly come within the scope of my contribution to the art.

I claim as my invention:

1. In a hydrotherapy nozzle assembly for controlling and directing a flow of aerated water, the assembly comprising:

a housing forming an axial flow passage for a stream of pressurized water, an air supply means comprising an ell member having a horizontal leg being an axially extending tubular member with an air port at an end thereof centered radially along the axis of said flow passage and a vertical leg communicating with a radially extending air conduit extending to an air intake opening, a ball member with internal nozzle means for universal swiveling movement about said axis, said ball member having respective rearward and forward spherical surfaces, a spherical socket portion formed in said housing to receive said rearward surface of said ball member, and a one-piece sealing and retention member received circumferentially about said forward spherical surface of the ball member and secured removably in the housing to retain the ball member swivelably in a selected axial position, said one-piece sealing and retention member more particularly comprising:

an annular lip formed on an interior diameter wall of said sealing and retention member, said lip comprising three wall portions, the first of said wall portions being an angled wall portion formed at an obtuse angle to said interior diameter wall, the latter being parallel to the axis of said sealing and retention member, said angled wall portion having a height and defining a smaller interior diameter by a second narrow wall portion parallel to said axis of said sealing and retention member so that said member is radially sized to fit between said ball and said housing, a third wall portion perpendicular to said axis of said sealing and retention member connecting said second narrow wall portion with said interior diameter wall and being flush with an end of said interior wall.

2. In a hydrotherapy nozzle assembly of the type comprising a hollow housing in which a ball mounted for universal pivoting movement with respect to the housing has rearward and forward spherical surface portions thereon, the improvement of means for retaining said ball in said housing comprising:

a one-piece annular seal member comprising a ring and an annular lip formed on an interior diameter wall of said ring, said lip comprising three wall portions, a first angled wall portion formed at an obtuse angle along said interior diameter wall, the latter being parallel to the axis of said ring, said angled wall portion having a height and defining a smaller interior diameter by a second narrow wall portion parallel to the axis of said ring so that said ring is radially sized to fit between said ball and said housing, a third wall portion perpendicular to said interior diameter wall connecting said second narrow wall portion with said interior diameter wall and being flush with an end of said ring, said lip being formed along said interior diameter wall so that said third wall portion is formed away from a rearward portion of the housing so that said first angled wall portion can sealingly and slidingly engage the adjoining spherical portion of said ball, and said ring having attachment means to engage the housing.

3. A hydrotherapy nozzle assembly comprising:

a hollow housing and having an axis and axial air and water inlets thereinto and a rearward portion of a ball socket formed therein about said axis, a ball having a nozzle passage formed therein and received in said rearward ball socket for universal swiveling movement about said axis, a one-piece circumferential seal member received in said housing, an annular flexible elastic lip formed on an interior diameter wall of said seal member and, extending radially inwardly from the interior diameter of said seal member to a diameter which is less than the outer diameter of the ball for engagement with the adjoining surface of the ball, attachment means for securing said seal member to said housing, whereby the ball is readily adjusted and retained swivelably in the housing while in contact with said lip.

4. A hydrotherapy nozzle assembly as defined in claim 3, wherein said member is a relatively high durometer, low friction elastomer material.

5. A hydrotherapy nozzle assembly as defined in claim 4, wherein said seal member is additionally secured in place by an escutcheon ring to provide for uniform loading against said ball around the entire circumference of said seal member.

6. A hydrotherapy nozzle assembly comprising:

a hollow housing and having an axis and axial air and water inlets thereinto and a rearward portion of a ball socket formed therein about said axis, a ball having a nozzle passage formed therein and received in said rearward ball socket for universal swiveling movement about said axis, a one-piece circumferential seal member received in said housing, an annular flexible elastic lip formed on an interior diameter wall of said seal member, said lip comprising three wall portions, a first angled wall portion formed at an obtuse angle to said interior diameter wall, the latter being parallel to the axis of said seal member, said angled wall portion having a height and defining a smaller interior diameter by a second narrow wall portion parallel to the axis of said sealing member so that said member is radially sized to fit between said wall and said housing, a third wall portion perpendicular to said interior diameter wall connecting said second narrow wall portion with said interior diameter wall and being flush with an end of said seal member, said first angled wall portion engaging sealingly against said ball, attachment means for securing said seal member to said housing, whereby the ball is readily retained swivelably in the housing.

7. In a hydrotherapy fitting of the type having an adjustable nozzle mounted in a ball socket coupling, the improvement of a ring clamping arrangement comprising:

a housing having a spherical socket recess of a selected diameter for receiving and seating the nozzle ball and including a radial wall extending outwardly of the socket recess, a plurality of equally spaced threaded recesses in said wall, a sealing and retaining ring complementary to said wall having an inner wall of a diameter larger than the selected diameter of said socket recess, a flexibly pliant lip on said inner wall projecting radially inwardly from said inner wall to a diameter less than said selected diameter for obtaining a clamping purchase on the adjoining surface of the nozzle ball, and screw fastener means in said ring and engageable with said threaded recesses to draw up said ring into sealing and retaining assembly with the housing and the nozzle ball.

8. A ring clamping arrangement as defined in claim 7, wherein said sealing and retaining ring is additionally secured in place by an escutcheon ring to provide for uniform loading against said ball around the entire circumference of said sealing and retaining ring.

* * * * *